US005261831A

United States Patent [19]

Vendal et al.

[11] Patent Number: 5,261,831

[45] Date of Patent: Nov. 16, 1993

[54] FLUORESCENT LAMP SOCKET

[75] Inventors: Mohammed J. Vendal, Plano; Labon B. Ruth, III, Lewisville, both of Tex.

[73] Assignee: Gulton Industries, Inc., Plano, Tex.

[21] Appl. No.: 958,864

[22] Filed: Oct. 9, 1992

[51] Int. Cl.[5] ..... H01R 13/00

[52] U.S. Cl. ..... 439/232

[58] Field of Search ..... 439/232, 233, 239, 226-231, 439/234-238, 240-244

[56] References Cited

U.S. PATENT DOCUMENTS 3,781,759 12/1973 Shelly, Jr. ..... 439/232

4,799,896 1/1989 Gaynor et al. ..... 439/242

*Primary Examiner*—Joseph H. McGlynn

*Attorney, Agent, or Firm*—Darby & Darby

[57] ABSTRACT

A fluorescent lamp socket disclosed is designed for use in environments subject to substantial vibration or shock. A fluorescent lamp is supported by its ferrule or end cap to firmly couple the lamp to the socket. The socket is provided with a retainer element for ready insertion or removal of the lamp. While the lamp is being inserted into the socket, the retainer element engages an edge of the lamp ferrule which impinges on a camming surface of the retainer element and forces the retainer element into a cavity of the socket body. At the same time, contact pins of the lamp are received in slots formed in the socket body having contacts disposed therein. The lamp contact pins cause the contacts to bow, thereby forming a reliable pressure contact between them. As the lamp ferrule continues to be inserted, the lamp ferrule will pass beyond the retainer element and the retainer element will be freed to be urged by a spring toward an extended position. The lamp will then be held snugly between a plurality of socket body extensions and the retainer element. The retainer element may be manually pushed into the socket body cavity for removing the lamp therefrom.

9 Claims, 3 Drawing Sheets

FLUORESCENT LAMP SOCKET

BACKGROUND OF THE INVENTION

The present invention relates in general to improved lighting fixtures and, more particularly, to an improved fluorescent lamp socket for use in environment subject to substantial vibration or shock.

Conventional fluorescent tubes or lamps have small contact pins extending outwardly from a ferrule or cap at each end of the tube. These contact pins are electrically connected to the internal electrodes of the lamp and have a diameter substantially less than that of the tube itself. Such lamps may have lengths ranging from less than 1 foot to as much as 8 feet.

Various forms of fluorescent lamp sockets are known in the art which are adapted to hold fluorescent tubes by these contact pins. In rigorous environments in which the lamps are subject to vibration and shock, the pins may be subject to breakage or damage because the entire weight of the lamp is supported by these pins. In addition, the effect of vibration and shock on a lamp placed in a conventional socket may create stresses in the lamp with respect to the socket, which often causes the contact pins to be dislodged or to momentarily break contact with the socket contacts. Such momentary break in electrical contact can cause jitter, bounce, or flicker in the tube and impair its desired light output. Such motion may further cause the filament of the cathode to break or weaken. Accordingly, it would be desirable to support a fluorescent lamp in a manner in which the tube is held firmly in place by means other than the contact pins.

With this problem in mind, the present invention is directed to a novel structure for supporting a fluorescent lamp. In accordance with the invention, the fluorescent lamp is supported in sockets by its ferrules or end caps. This results in a more secure mounting of the tube because the tube and socket become firmly coupled. At the same time, the electrical contact between the contact pins of the lamp and the contacts of the socket is more reliably maintained without the jitter, bounce, or flicker associated with lamp motion resulting from a less firm coupling. In addition, provision is made for ready insertion or removal of the tube.

SUMMARY OF THE INVENTION

It is an object of the present invention to provide a novel means for supporting fluorescent lamps.

Another object is to provide a means to reduce jitter, bounce, or flicker of fluorescent tubes used in rigorous environments.

An additional object is to provide means to firmly couple a fluorescent lamp to a socket to prevent motion of the lamp relative to the socket even under vibration or shock.

A further object is to provide an improved means of supporting fluorescent lamps in which the lamp is supported at each end by its ferrule or end cap.

Yet another object of this invention is to provide a fluorescent lamp socket with the foregoing advantages with minimal cost and complexity.

These and other objects are achieved according to the present invention by securing or locking the ferrule of a fluorescent tube firmly in place in a socket body. In a preferred form, the lamp socket of the present invention supplies current to a fluorescent lamp having a pair of external contact pins extending away from a ferrule, and comprises: a socket body having a front wall with at least one extension directed outwardly from the front wall, a cavity through the socket body substantially opposite at least one of the extensions, and a pair of parallel slots extending from an outer edge of the socket body toward a central portion thereof; contacts disposed in these slots for connection to the lamp contact pins; and a retractable retainer element mounted in the cavity and having a first extended position adapted to hold the lamp ferrule between the retainer element and at least one of the extensions, the retainer element having a second retracted position adapted to permit inserting or removing the lamp. As a further feature of the present invention, the lamp socket is provided with biasing means for normally resiliently biasing the retainer element toward its first position. As yet a further feature of the present invention, the retainer element has a camming surface such that when the lamp ferrule is pressed against the camming surface, the retainer element slides from its first normally biased position to a second retracted position permitting insertion of the lamp, the retainer element returning to its first position after the lamp has passed the retainer element, whereby the lamp is automatically secured in the socket.

DESCRIPTION OF A PREFERRED EMBODIMENT

Figure 1:
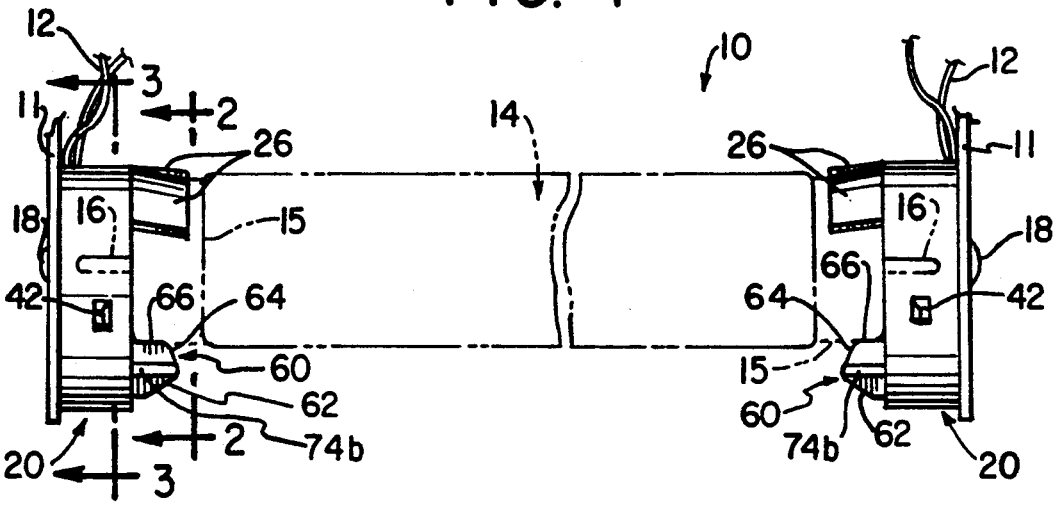
FIG. 1 shows a side elevational view of a lighting fixture holding a conventional fluorescent lamp in the socket of the present invention.

Referring to the drawings, FIG. 1 shows a side elevational view of two lamp sockets 10 of the present invention fitted with a fluorescent lamp 14. Lamp 14 conventionally has a ferrule 15 at either end with contact pins 16 (shown in phantom) extending outwardly therefrom. Lamp 14 is preferably seated with its ferrule engaging a front wall 21 of a socket body 20 and, as will be described in greater detail below, lamp 14 is firmly secured in the socket 10 between a retractable retainer/ejector member 60 and at least one frontward extension 26 from socket body 20.

Figure 2:
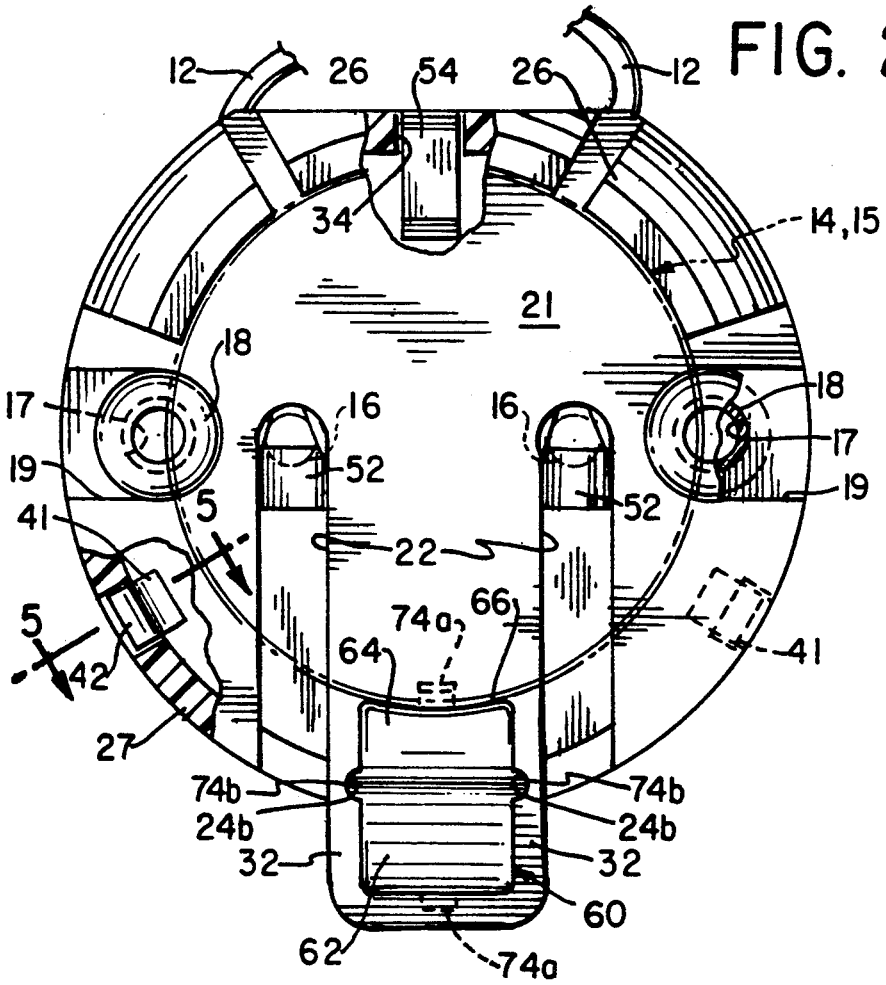
FIG. 2 is a sectional view along line 2—2' of FIG. 1.

FIG. 2 shows a sectional view of the socket 10 in a preferred embodiment. This view shows the spatial relationship of the body extensions 26 to the retainer element 60. To secure lamp 14, at least one extension 26 is disposed substantially opposite the retainer element 60 to hold the lamp securely.

Referring to FIGS. 2–6, socket body 20 has a front wall 21 adapted to be juxtaposed to the lamp ferrule 15. One or more extensions 26 extend from the front wall 21 to overlie an inserted lamp ferrule. Extensions 26 are preferably curved to conform to the curvature of the ferrule, and form a partial seat or cradle for the ferrule.

Extensions 26 are preferably also inclined with respect to front wall 21 and are elastically flexible to retain the ferrule against the retainer element 60 as described below. Alternatively, extension 26 could extend perpendicularly to the front wall 21 where the distance between the retainer element 60 and extensions 26 is selected so that said lamp ferrule 15 will be securely held. The size and number of extensions 26 are selected as desired for properly holding the lamp ferrule 15.

Figure 3:
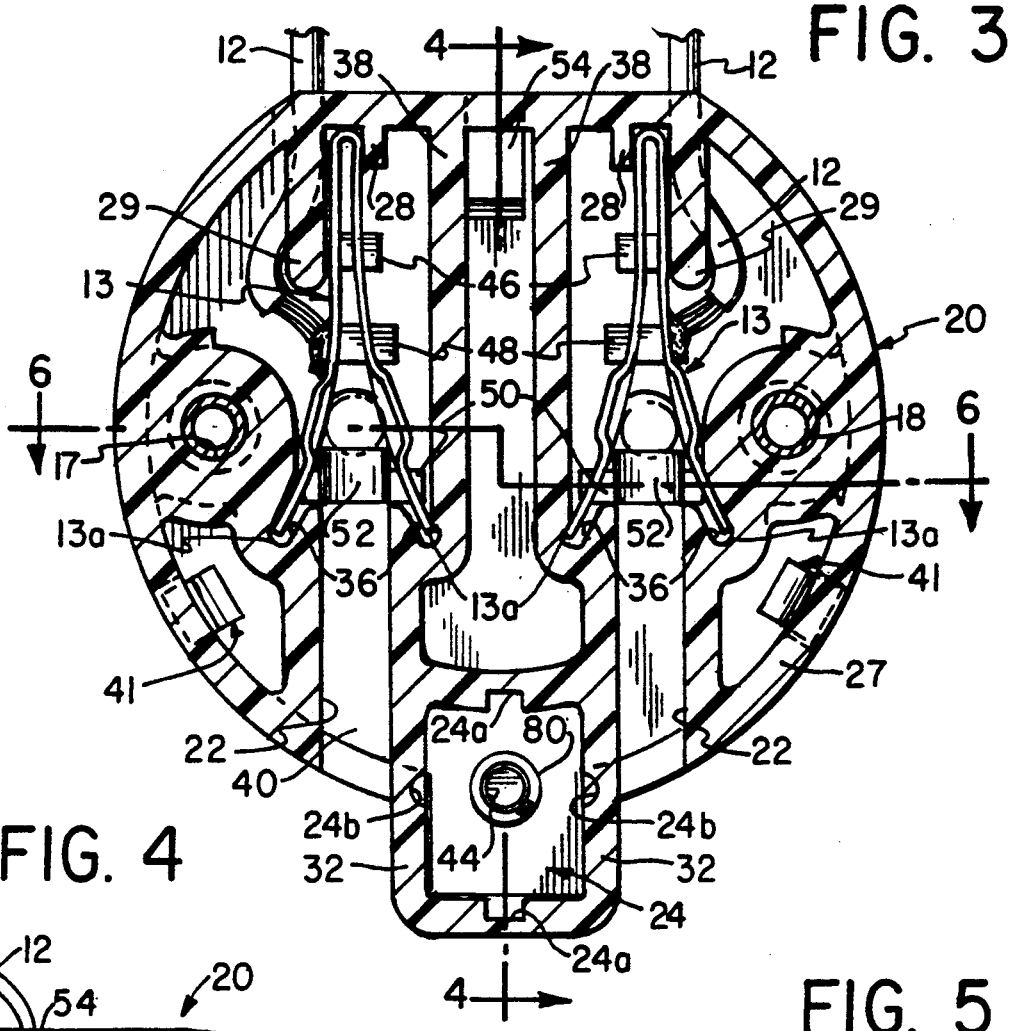
FIG. 3 is a sectional view along line 3—3' of FIG. 1.
Figure 4:
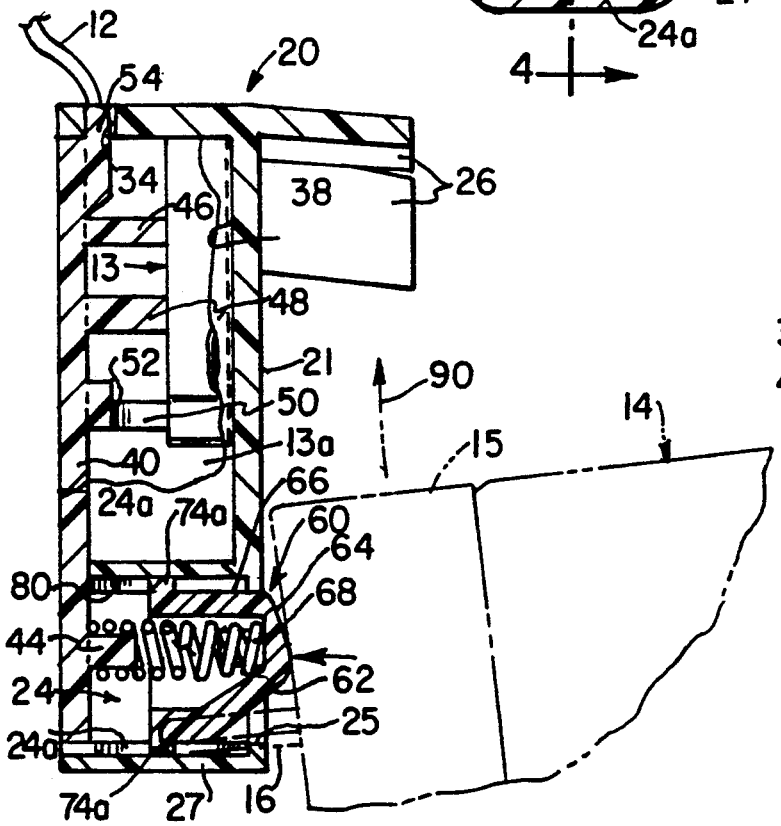
FIG. 4 is a fragmentary sectional view substantially taken along line 4—4' of FIG. 3.

FIGS. 3 and 4 illustrate more particularly several features of the preferred embodiment. Socket body 20 possesses symmetry about line 4,4' and, therefore, the following description is presented with reference to either of the two sides of line 4,4' with the understanding that a corresponding structure is preferably, but need not necessarily be, formed on the other side of line 4,4'. The socket body 20 is formed with a cavity 24 formed by cavity walls 32 extending rearward from wall 21. Cavity 24 forms a passageway within which retainer element 60 slides between an extended position and a retracted position. It is shown in FIG. 4 in a partially retracted position. Grooves **24*a* are formed in sidewalls 32 and grooves 24*b* are formed in the top and bottom walls of the cavity 24. Retainer element 60 is formed with ridges 74*b* which correspond with and engage grooves 24*b* so that retainer element may slide between its extended and retracted positions without turning. The generally rectangular cross sections of the cavity and retainer element also aid in preventing such turning. Retainer element 60 also has projections 74*a* which engage grooves 24*a*. The extended position of retainer element 60 is defined by the termination of grooves 74*a* which do not pass through wall 21, and this limits further outward motion of retainer element 60. Preferably, grooves 24*a* are terminated by the front wall 21 of the socket body 20. Alternatively, other means known in the art could be used to confine the movement of retainer element 60**.

With further reference to FIG. 4, the structure and operation of retainer element 60 can be better described. Retainer element 60 is provided with a slanted camming surface 62 on an under portion thereof, which causes the retainer element to retract into the cavity of socket body 20 when a lamp ferrule 15 is inserted in the direction of arrow 90. The retainer element is hollow, and a stub 68 is provided in its interior, extending generally axially of the retainer element for engaging inside one end of a coil spring 80 for use in normally biasing the retainer element to its extended position.

Socket body 20 is further provided with a pair of parallel slots 22 extending from an outer edge of body 20 toward a central portion thereof. These slots are adapted to receive contact pins 16 of lamp 14 and are of a length sufficient to permit lamp ferrule 15 to travel past retainer element 60 so that element 60 and extensions 26 can securely hold the lamp ferrule 15. As shown, the two slots 22 straddle retainer element 60. This facilitates the automatic locking feature of socket 10 as is more fully described below.

The rear surface of socket body wall 21 is further formed with first and second interior walls 87,89 spaced from one another so as to define the slot 22 for receiving a contact pin 16. Another slot 22 is formed symmetrically with and spaced from the first slot so as to receive a second contact pin 16 of a conventional fluorescent lamp 14. Each of the first and second interior walls 87,89 has a recess 36 formed in it which has a mouth or opening directed toward an inner portion of said socket body, useful in retaining metallic contacts 13. Each contact 13 is preferably of a hairpin shape, having two legs curving inwardly from ends **13*a* toward a U-shaped end. The end 13*a* of each contact is positioned in a recess 36, while the U-shaped end is retained between two projections 28,29 formed in the sidewall 27 of the socket body. Each contact 13 is adapted to engage a contact pin 16 between the contact legs, which are resiliently flexible to make good electrical contact with contact pin 16. It will be understood that contacts 13 could be of some other shape suitable for their purpose. Contacts 13 are preferably disposed with edges abutting the rear surface of the front wall 21 of the socket body as shown in FIG. 4. Thus, an edge of contacts 13 rests against the rear surface of the front wall 21, the contacts being placed in the recesses 36 and between projections 28, 29**.

Figure 5:
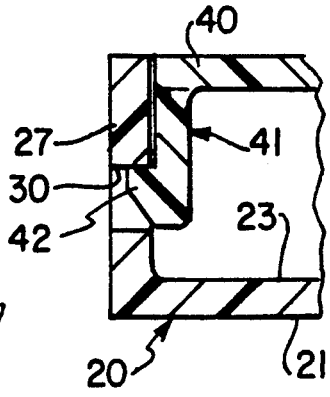
FIG. 5 is a fragmentary sectional view along line 5—5' of FIG. 2.

The socket body 20 is closed by a back plate 40 generally parallel to the front wall 21 which serves to retain the contacts 13 and retainer element 60 and coil spring 80 as a single unit. As shown in FIGS. 4 and 5, back plate 40 has a projection 54 on one edge which engages a hole or recess 34 in the sidewall 27 of socket body 20. At an opposite edge, back plate 40 is formed with at least one locking finger 41 having a hook 42 adapted to fit into a hole 30 in the sidewall 27 of socket body 20. Finger 41 is elastically flexible, so that after engaging projection 54 in hole 34, the back plate may be pressed into sidewall 27 until a hook 42 engages hole 30 to retain back plate 40 in place.

Back plate 40 is also formed with projections 46, 48, 50, which abut the outer edges of the contacts 13 and support the contacts 13 against wall 21 at various points between their U-shaped ends and free ends **13*a*. Projection 50 has a recess 52 formed in it to permit contact pins 16 of lamp 14 to pass projection 50 in slots 22 once the back plate 40 and the socket body 20 are assembled. Back plate 40 further has a projection 44 aligned with projection 66 of retainer element 60 when assembled. Projection 44 is adapted to engage the spring 80** at its outer end.

In assembling the socket, the contacts 13, retainer element 60, and spring 80 are positioned on the inside of socket body 20. Back plate 40 is then snapped into place, and retains the contacts 13 in position, as well as compressing spring 80 to urge the retainer element 60 to its extended position.

In operation, a lamp 14 has its contact pins 16 inserted into slots 22 on either side of the retainer element 60. While the lamp ferrule 15 is being inserted into socket 10 in the direction of arrow 90, retainer element 60 engages the edge of the ferrule which impinges on the camming surface 62 and forces the retainer element 60 back into the cavity 24, as seen in FIG. 4, allowing the ferrule to pass beyond the retainer element 60. At the same time, contact pins 16 are received by the slots 22 having the contacts 13 disposed therein. The contact pins 16 cause the contacts 13 to bow, forming a reliable pressure contact between them. As lamp ferrule 15 continues to be inserted in the direction of arrow 90, the ferrule 15 will pass beyond the retainer element 60, and the retainer element 60 will be freed to be urged by spring 80 toward its extended position. The upper surface 66 of the retainer element 60 then holds the ferrule snugly against the body extensions 26, which will flex or otherwise contact the lamp ferrule 15 so as to form a close fit between the socket body extension 26 and the ferrule 15. Once a close fit is established, the lamp ferrule 15 will have cleared the upper locking surface 66 of retainer element 60 and the retainer will lock the lamp 14 in the socket 10. This results in holding the tube firmly in place, with a reliable pressure contact between the contact pins 16 and the socket contacts 13, to enable the socket 10 to supply current to the lamp 14 from a current source connected through wire leads 12 which are in turn connected to the contacts 13.

To remove the lamp 14 from the socket 10, the retainer element 60 may be manually pushed into cavity 24, so that ferrule 15 can pass. The contact pins 16 are then removed from slots 22 by withdrawing the lamp further. The socket contacts 13 return to their natural stand-by shape upon the removal of the bowing force induced by the contact pins 16.

Figure 6:
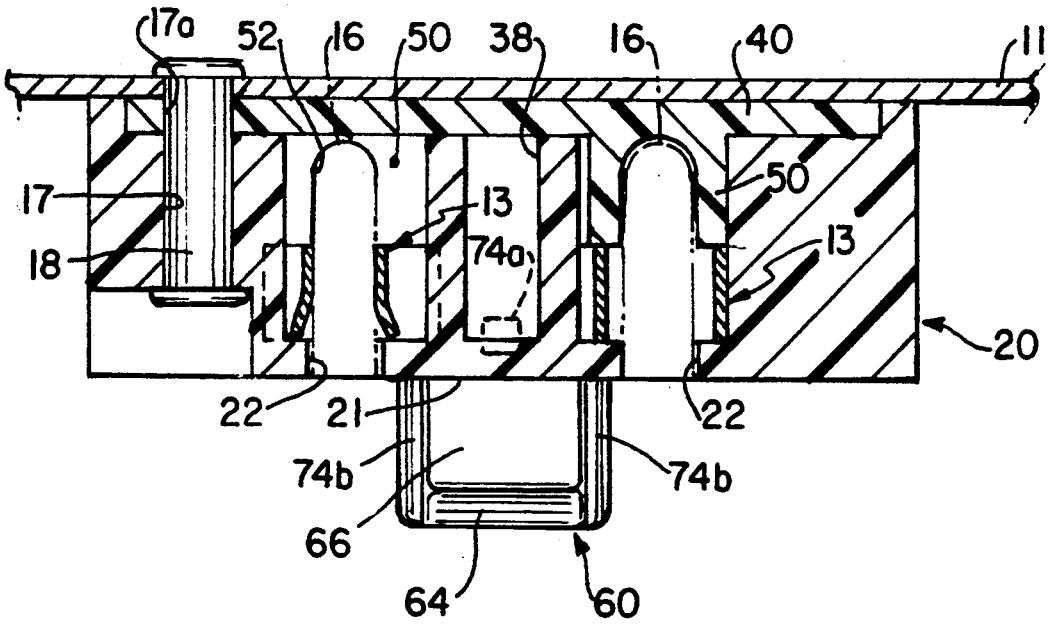
FIG. 6 is a sectional view along line 6—6' of FIG. 3.

Referring to FIG. 6, the assembled socket 10 is further provided with mounting holes 17 to be able to mount the socket 10 on a desired external support 11. Socket body 20 has a hole 17 and a recess 19 in its front wall 21 surrounding hole 17 so that a mounting screw or rivet 18 will not protrude from the front wall 21. Back plate 40 has a hole 17*a* which is aligned with hole 17 upon assembly of the socket 10.

It will be seen that the socket body 20, the back plate 40, and retainer element 60 lend themselves readily to being molded of plastic material, as by injection molding, thereby providing an economical method of fabrication in production. Also, the present socket assembly has a minimum number of parts, enhancing its economy of production.

One skilled in the art will readily appreciate that coil spring 80 may be replaced by a leaf spring or other biasing means. Likewise, retainer element 60 may be retained in the socket body by means other than protuberances 74*a*. Moreover, extensions 26, while preferably made of elastic or flexible material to hold the lamp ferrule 15 firmly, could be rigid and spaced from the locking upper surface of retainer element 60 at a distance in conformity with design dimensions of conventional fluorescent tubes. Alternatively, a rigid or semi-rigid extension may be provided with an elastic material attached thereto to yieldably seat the lamp ferrule 15 between extensions 26 and the locking surface 66.

From the foregoing description, it will be clear that the present invention may be embodied in other specific forms without departing from the spirit or essential characteristics thereof. The presently disclosed embodiment is therefore to be considered in all respects as illustrative and not restrictive, the scope of the invention being indicated by the appended claims, and not limited by the foregoing description.

We claim:

1. A lamp socket for supplying current to a fluorescent lamp having a pair of external contact pins extending away from a ferrule, comprising:

a socket body having a front wall;

said body being provided with at least one fixedly mounted extension directed away from said front wall, said body having a hole therethrough disposed substantially opposite at least one of said extensions, said body also having a pair of parallel slots extending from an outer edge of said body toward a central portion thereof;

contact means disposed in said slots for connection to said lamp contact pins;

a retainer element retractably mounted in said hole having a first position adapted to secure said lamp ferrule between said retainer element and at least one of said extensions, and having a second position adapted to permit insertion or removal of said lamp; and biasing means for normally resiliently biasing said retainer element toward said first position, said retainer element having a first surface adapted to engage and retain said ferrule and a camming surface opposite said first surface adapted so that when said lamp ferrule bears against said camming surface during insertion of said lamp, said retainer element retracts from said first normally biased position to said second position to permit insertion of said lamp, said retainer element returning to said first position after said lamp has passed said first surface, whereby said lamp ferrule is automatically secured in said socket.

2. A lamp socket as in claim 1, wherein said biasing means is a compression spring.

3. A lamp socket as in claim 1, wherein said socket body further has a pair of holes, and a pair of wire leads in said holes and connected to said contact means.

4. A lamp socket as in claim 1, wherein at least one said extension is inclined with respect to said socket body and is elastically flexible, said socket body yieldably seating said lamp ferrule between said extension and said retainer element.

5. A lamp socket as in claim 1, wherein said socket body front wall has a rear surface and a pair of spaced interior walls extending from said rear surface to define each of said pair of parallel slots therebetween.

6. A lamp socket as in claim 5, wherein said contact means is a hairpin-shaped conductive member cooperating with each said slot.

7. A lamp socket as in claim 6, wherein each of said spaced interior walls has a recess formed therein, said recess having an opening directed toward an inner portion of said socket body and retaining a respective leg of said hairpin-shaped conductive members.

8. A lamp socket as in claim 7, further comprising a back plate engaging the rear surface of said socket body and having support means for supporting said hairpin-shaped conductive members in said socket body.

9. A lamp socket for supplying current to a fluorescent lamp having a pair of external contact pins extending away from a ferrule, comprising:

a socket body having a front wall and a sidewall with a recess therein;

said body being provided with at least one extension directed away from said front wall, said body having a hole therethrough disposed substantially opposite at least one of said extensions, said body also having a pair of parallel slots extending from an outer edge of said body toward a central portion thereof;

contact means disposed in said slots for connection to said lamp contact pins;

a retainer element retractably mounted in said hole having a first position adapted to secure said lamp ferrule between said retainer element and at least one of said extensions, and having a second position adapted to permit insertion or removal of said lamp;

a back plate provided with at least one locking finger extending therefrom; and a flexible hook located at an end of said finger and engagably received in said recess of said sidewall.

* * * * *